US006155263A

United States Patent [19]

Weaver

[11] Patent Number: 6,155,263

[45] Date of Patent: Dec. 5, 2000

[54] PROTECTIVE ARM AND HAND COVERING FOR A HEALTHCARE PATIENT TO PREVENT LYMPHEDEMA

[76] Inventor: Lois A. Weaver, 1190 Parkside Ave., Trenton, N.J. 08618

[21] Appl. No.: 09/504,143

[22] Filed: Feb. 15, 2000

[51] Int. Cl.[7] ..... A61F 5/37

[52] U.S. Cl. ..... 128/878; 128/879; 602/3

[58] Field of Search ..... 128/846, 877, 128/878, 879, 882; 602/20, 21, 22, 3

[56] References Cited

U.S. PATENT DOCUMENTS

| | | | |
|---|---|---|---|
| 4,330,887 | 5/1982 | White | 2/16 |
| 4,991,233 | 2/1991 | Hall | 2/115 |
| 5,357,633 | 10/1994 | Rael | 2/16 |
| 5,628,062 | 5/1997 | Tseng | 2/16 |
| 5,734,992 | 4/1998 | Ross | 2/161.7 |

*Primary Examiner*—Michael A. Brown

*Attorney, Agent, or Firm*—Sperry, Zoda & Kane

[57] ABSTRACT

A protective arm and hand covering for a healthcare patient in a healthcare with healthcare workers which includes warning notices on the external surface thereof to notify a healthcare worker that no healthcare activities are to be conducted with respect to one specific hand and arm of the patient because this patient has a propensity for lymphedema. The hand and arm covering is adapted to completely cover the upper and lower arm area on both sides of the elbow as well as the entire wrist, hand and finger area of the user. The device can include a plurality of markings or indicia on the external surface thereof warning healthcare workers that various activities such as blood pressure, venipuncture and intravenous are not to be performed with respect to that specific arm. Other warning graphic representations can be included in order to notify a healthcare worker that blood pressure or intravenous lines or blood should not be drawn from that particular arm even in those situations where the patient is asleep and is unable to notify the healthcare worker that all these activities are to be performed with respect to the patient's other arm.

20 Claims, 2 Drawing Sheets

PROTECTIVE ARM AND HAND COVERING FOR A HEALTHCARE PATIENT TO PREVENT LYMPHEDEMA

BACKGROUND OF THE INVENTION

1. Field of the Invention

The present invention deals with the field of devices for providing medical alert information to healthcare workers. The conveying of medical alert information to healthcare workers is a very rapidly growing field which can encompass many different types of devices. For example, bracelets or anklets or necklaces with important medical information imprinted thereon are commonly used today. The present invention provides a specific type of medical alert information carried upon an arm, hand and finger covering of a user to notify a healthcare worker that no healthcare activities should be performed with respect to the user's arm. This device is primarily designed to be worn within a healthcare environment such as a hospital and is particularly useful in those situations where a user is asleep or unconscious or in a coma and, as such, cannot notify the healthcare worker at the time of servicing that such activity should not be performed with respect to that specific arm. As such, the present invention falls into the general field of medical alert devices.

2. Description of the Prior Art

Other devices have been utilized for the purposes of providing medical alert for carrying information or other indicia upon clothing material or for protecting hands, arm and fingers of a user or for preventing unwanted contact of a material or fluid with respect to the hand, arm or fingers of a particular user such as U.S. Pat. No. 1,837,148 patented Dec. 15, 1931 to A. G. David and assigned to The Nevins-Church Press on an "Advertising Cuff"; and U.S. Pat. No. 3,416,518 patented Dec. 17, 1968 to B. M. Samuels et al on a "Cast Cover"; and U.S. Pat. No. 3,638,334 patented Feb. 1, 1972 to E. Malikowski on a "Training Garment"; and U.S. Pat. No. 3,648,291 patented Mar. 14, 1972 to A. Pankers and assigned to William A. Braddock on a "Protective Garment For Bedridden People"; and U.S. Pat. No. 4,254,566 patented Mar. 10, 1981 to S. Haskell on a "Jogger And Runner Shoe Identification"; and U.S. Pat. No. 4,330,887 patented May 25, 1982 to Joanne White on "Terry Cloth Gloves (Terry Grippers)"; U.S. Pat. No. 4,710,981 patented Dec. 8, 1987 to David Sanchez on an "Interactive Message Garment"; and U.S. Pat. No. 4,742,578 patented May 10, 1988 to Arnold Seid on a "Penetration-Resistant Surgical Glove"; and U.S. Pat. No. 4,991,233 patented Feb. 12, 1991 to Andrew Hall on a "Garment With Indicia"; and U.S. Pat. No. 4,991,337 patented Feb. 12, 1991 to Laurie Solon on an "Inexpensive Disposable Identification Bracelet"; and U.S. Pat. No. 5,023,953 patented Jun. 18, 1991 to Laurence A. Bettcher and assigned to Bettcher Industries, Inc. on a "Garment And Protective Sleeve"; and U.S. Pat. No. 5,084,915 patented Feb. 4, 1992 to J. Shotwelkl et al on a "Method Of Displaying Information"; and U.S. Pat. No. 5,187,813 patented Feb. 23, 1993 to L. Klein and assigned to Levrette Lee Klein on a "Combination Napkin And Sleeve/Forearm Protector (Cuff-Nap); and U.S. Pat. No. 5,335,372 patented Aug. 9, 1994 to G. Wiedner et al and assigned to Rotecno AG on an "Article Of Clothing, In Particular For The Medical Or Chemical Field"; and U.S. Pat. No. 5,357,633 patented Oct. 25, 1994 to G. Rael on an "Arm Protective Garment"; and U.S. Pat. No. 5,379,461 patented Jan. 10, 1995 to R. Wilmers on an "Interactive Clothing with Indicia And Cover Panel"; and U.S. Pat. No. 5,4022,536 patented Apr. 4, 1995 to J. Matthews on a "Forearm Protector For Medical, Dental And Other Health Care Workers"; and U.S. Design Pat. No. Des.357,567 patented Apr. 25, 1995 to L. Fingleson et al on a "Garment Having Printed Instructions For Self-Examination Of The Breasts"; and U.S. Pat. No. 5,444,871 patented Aug. 29, 1995 to F. Lopez and assigned to Johnson & Johnson Medical, Inc. on a "Medical Gown With Seamless Sleeve Protector"; and U.S. Pat. No. 5,511,241 patented Apr. 30, 1996 to G. Ziegler and assigned to Azon Corporation on "Chain Mail Garments Impregnated With An Elastomeric Material"; and U.S. Pat. No. 5,519,952 patented May 28, 1996 to C. Kolton et al and assigned to B&G Plastics, Inc. on a "Belt And Indicator Assembly"; and U.S. Pat. No. 5,542,121 patented Aug. 6, 1996 to P. Lahaussois et al and assigned to Dale Strohl on a "Dispensable, Disposable Reversible Forearm Protector"; and U.S. Pat. No. 5,546,955 patented Aug. 20, 1996 to P. Wilk on a "Medical Stocking For Temperature Detection"; and U.S. Pat. No. 5,601,895 patented Feb. 11, 1997 to F. Cunningham on a "Flexible Puncture Proof Material"; and U.S. Pat. No. 5,628,062 patented May 13, 1997 to L. Tseng on an "Arm And Hand UV Protection Sleeve For Driving"; and U.S. Pat. No. 5,638,546 patented Jun. 17, 1997 to D. Vita on an "Arm Warmer Garment"; and U.S. Pat. No. 5,682,616 patented Nov. 4, 1997 to M. Pisano on a "Hosiery Having A Protective Sleeve For Preventing Debris-Intrusion"; and U.S. Pat. No. 5,734,992 patented Apr. 7, 1998 to M. Ross for a "Protective Hand And Arm Covering Article"; and U.S. Pat. No. 5,802,876 patented Sep. 8, 1998 to A. Miller et al on a "Bracelet"; and U.S. Design Pat. No. Des.398,862 patented Sep. 29, 1998 to D. Craven on a "Medical-Alert Wristwatch"; and U.S. Pat. No. 5,909,801 patented Jun. 8, 1999 to H. Coffman on an "Arm Warming Sleeve"; and U.S. Design Pat. No. Des.415,058 patented Oct. 12, 1999 to R. Haase on a "Medical Condition Bracelet"; and U.S. Pat. No. 5,974,586 patented Nov. 2, 1999 to D. Reinoso on a "Sunlight Blocking Sleeves".

SUMMARY OF THE INVENTION

The present invention provides a protective arm and hand covering for a patient for preventing a healthcare worker from having access to a particular arm and hand area in order to prevent a patient from experiencing lymphedema.

Lymphedema is a likely side effect of breast cancer surgery and/or treatment. Lymphedema manifests itself as the swelling of an arm and hand area which is a common side effect of lymph node removal and/or radiation therapy.

Lymphedema is actually a swelling of the arm caused by an abnormal accumulation of lymph fluid. Usually such swelling occurs in an arm after radiation therapy or lymph node removal has been performed on a man or woman for the purposes of treatment of breast cancer.

Lymphedema can become a chronic and progressive condition. However, it can usually be brought under control through proper care.

It is well known that the over abundant use of radiation therapy can cause extreme cases of lymphedema and this has occurred recently in the United States due to the many treatments of breast cancer that are performed in this manner. Lymphedema can be an unwanted side effect of such treatment.

Technically lymphedema is the swelling of subcutaneous tissues due to obstruction, destruction or hypoplasia of lymph vessels resulting in the accumulation of excessive lymph fluid. Such a condition can cause extreme pain and swelling which is often difficult to differentiate from the actual signs and symptoms of other conditions such as venous thrombosis. Such cases of lymphedema are significantly aggravated by any type of trauma or other contact with the affected area.

In the case of conventional breast cancer therapy wherein a plurality of lymph nodes are removed adjacent one of the arms of a patient, it is important that that arm in the future no longer be used for the purposes of healthcare testing such as blood pressure testing, intravenous line maintenance or the taking of blood for testing or other purposes. Thus, the present invention provides an apparatus which can be worn by a breast cancer patient who has had lymph nodes removed adjacent one of his or her arms in order to provide immediate notice to healthcare workers that they are not to conduct any healthcare activities with respect to that specific arm. The protective arm covering is designed to extend over the entire arm, wrist, hand and finger area such that these tests are not performed. The material can be of an impenetrable material to physically prevent actual contact. The notices or warnings or other indicia on the external surface of the protective arm and hand covering can inform the healthcare worker that no tests are to be performed on this arm or more particularly no blood pressure should be taken from this arm or no venipuncture should occur on this arm for any reason or no intravenous should occur on this arm.

Such a covering is particularly important in healthcare environments wherein a patient may be unconscious, asleep, in a coma or under anesthetic and unable to inform the healthcare worker that they are performing a healthcare activity with respect to an arm which is highly susceptible to lymphedema. The healthcare worker at that time should be directed to perform this activity with respect to the opposite arm and the protective arm and hand covering of the present invention provides that notice to the healthcare worker despite the level of consciousness or alertness of the patient.

The particular construction of the apparatus of the present invention includes a protective arm and hand covering with an upper extremity covering including a tubular arm covering as well as a hand covering. The tubular arm covering extends over and around the arm of a patient and defines an arm entry opening therein to facilitate placement of a patient's arm into the tubular arm covering to allow it to extend over and around the arm of a user. The tubular arm covering preferably also includes a hand exit opening defined therein spatially disposed from the arm entry opening to allow the hand of a patient to extend outwardly therethrough. The tubular arm covering preferably is made of an impenetrable woven fabric such as Kevlar or other similar material which is resistant to penetration thereof in order to further prevent access to the arm of a patient by a healthcare worker. The tubular arm covering preferably also includes a transparent window which facilitates viewing of hospital identification bracelets or medical identification bracelets therethrough.

The upper extremity covering further includes a hand covering preferably extending over and around the hand of a patient. This hand covering preferably defines a hand entry opening therein to facilitate placement of a patient's hand thereinto. This hand covering includes a finger covering area positioned extending over and around the fingers of a patient to prevent access thereto. The tubular arm covering and the hand covering are preferably integral with respect to one another with the hand exit opening in registration contiguous with respect to the hand entry opening. The hand covering is preferably also made of an impenetrable woven fabric such as Kevlar or other material which is resistant to penetration thereof in order to further prevent access to the arm of a patient by a healthcare worker.

The protective arm and hand covering may preferably include a warning indicia displayed prominently on the tubular arm covering to discourage healthcare workers from accessing this particular arm and hand of a patient. Such warning indicia is preferably displayed on the tubular arm covering adjacent the arm entry opening and adjacent the front of the patient's elbow area to further discourage access by the healthcare worker. Such warning indicia can include warnings such as "NO BLOOD PRESSURE" or "NO VENIPUNCTURE" or "NO INTRAVENOUS" or "NO TESTS ON THIS ARM". It would be normal that the "NO BLOOD PRESSURE" note be placed upwardly on the arm above the elbow at a location near the arm entry opening where blood pressure would normally be taken. It is also preferable that the notations "NO VENIPUNCTURE" and "NO INTRAVENOUS" be placed lower near the bend of the elbow or near the back of the hand where it is more common for such venipuncture or intravenous contact to be normally made.

It is an object of the present invention to provide a protective arm and hand covering for a patient for discouraging access thereto by a healthcare worker in order to prevent lymphedema wherein the arm and hand are covered by a comfortable woven fabric which includes notices on the external surface thereof to notify the healthcare worker that no testing is to be performed with respect to this particular hand or arm.

It is an object of the present invention to provide a protective arm and hand covering for a patient for discouraging access thereto by a healthcare worker in order to prevent lymphedema wherein a protective arm and hand covering is provided which is impenetrable to puncture.

It is an object of the present invention to provide a protective arm and hand covering for a patient for discouraging access thereto by a healthcare worker in order to prevent lymphedema wherein the tubular arm covering thereof includes a transparent window for viewing of a patient's hospital identification bracelet commonly positioned about the patient's wrist.

It is an object of the present invention to provide a protective arm and hand covering for a patient for discouraging access thereto by a healthcare worker in order to prevent lymphedema wherein the number of moving parts is minimized to prevent any maintenance requirements.

It is an object of the present invention to provide a protective arm and hand covering for a patient for discouraging access thereto by a healthcare worker in order to prevent lymphedema wherein the covering can be easily washed for any purpose.

It is an object of the present invention to provide a protective arm and hand covering for a patient for discouraging access thereto by a healthcare worker in order to prevent lymphedema wherein full notification is provided even where a patient is unconscious, asleep, in a coma or under sedation.

It is an object of the present invention to provide a protective arm and hand covering for a patient for discouraging access thereto by a healthcare worker in order to prevent lymphedema wherein swelling of a person's arm caused by the abnormal accumulation of lymph fluids is minimized.

It is an object of the present invention to provide a protective arm and hand covering for a patient for discouraging access thereto by a healthcare worker in order to prevent lymphedema wherein a clear indication or designation is made of an arm which is adjacent to a position where lymph nodes may have been previously removed and, as such, any trauma such as healthcare testing should be performed with respect to the opposite arm or elsewhere.

It is an object of the present invention to provide a protective arm and hand covering for a patient for discouraging access thereto by a healthcare worker in order to prevent lymphedema wherein lymphedema is prevented by minimizing trauma to an arm and hand adjacent to an area where lymph nodes have been removed.

It is an object of the present invention to provide a protective arm and hand covering for a patient for discouraging access thereto by a healthcare worker in order to prevent lymphedema wherein a relatively inexpensive item is provided which significantly eases the worry of patient in the healthcare environment by providing automatic notice of a tendency for lymphedema in one of the patient's upper extremities.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
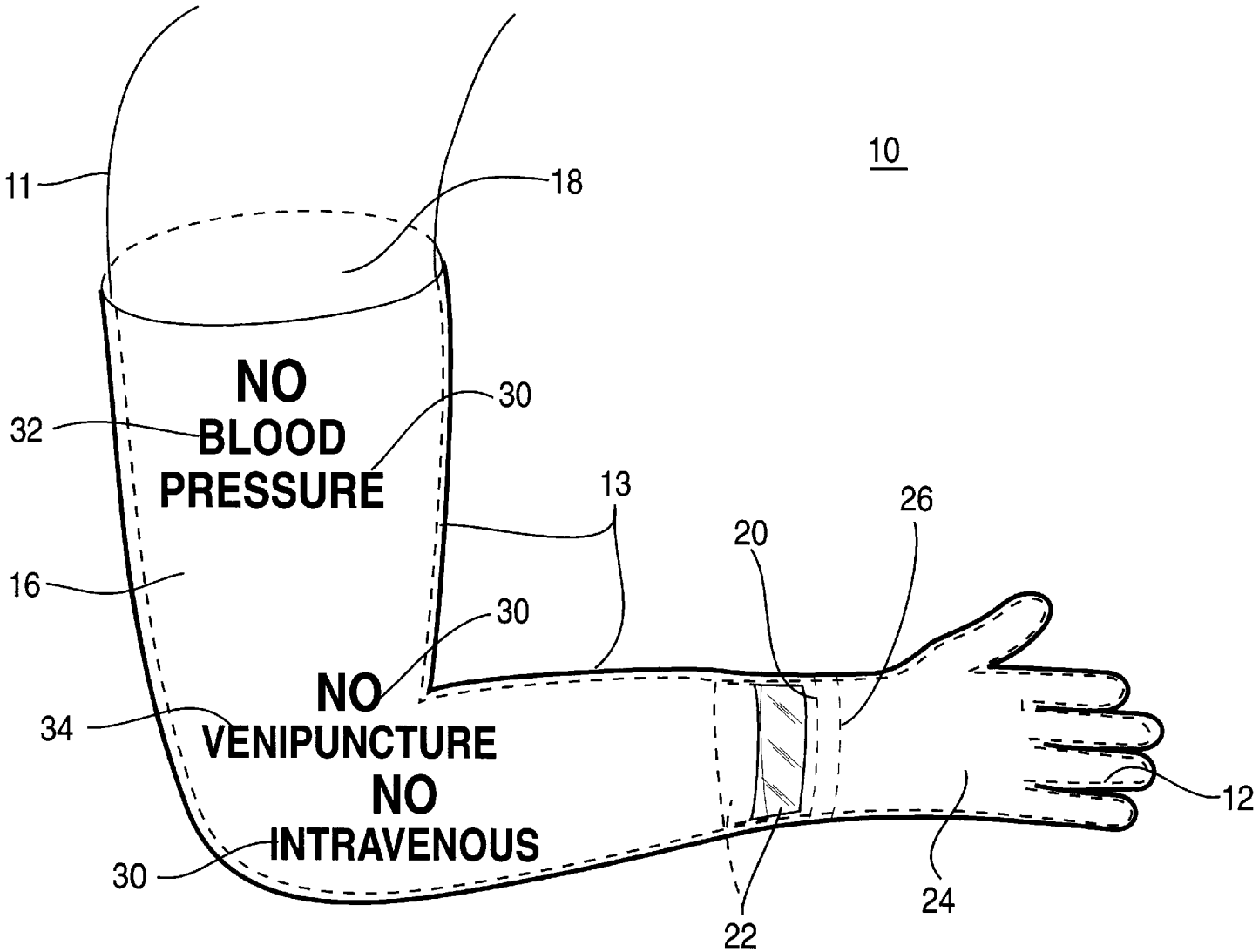
FIG. 1 is a perspective illustration of an embodiment of the protective arm and hand covering of the present invention showing warning indicia prominently displayed thereon.
Figure 4:
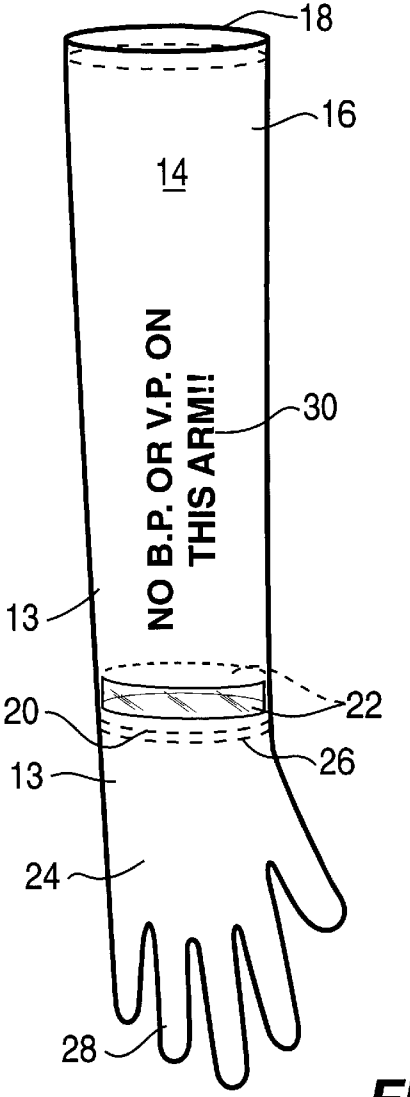
FIG. 4 is a back plan view of an alternative embodiment of the present invention.
Figure 3:
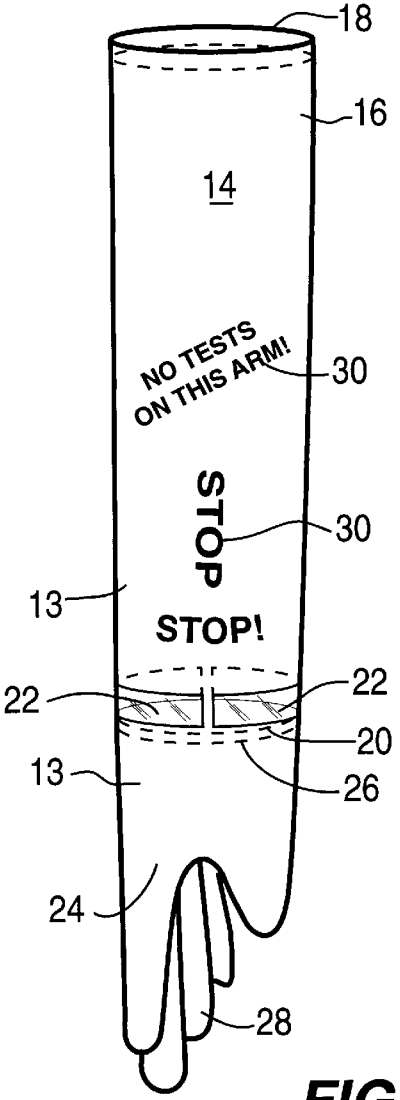
FIG. 3 is a side plan view of an alternative embodiment of the present invention.
Figure 2:
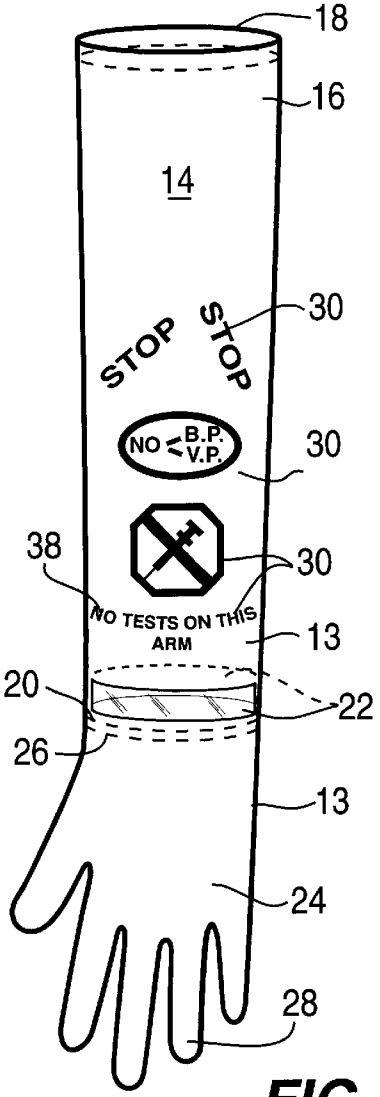
FIG. 2 is a front plan view of an alternative embodiment of the present invention.

The present invention provides a protective arm and hand covering 13 for a patient 10 for preventing access thereto by a healthcare worker in order to prevent lymphedema from occurring in the patient's arm 11 or a patient's hand 12.

Lymphedema is the swelling of the subcutaneous tissues which result from obstruction, destruction or hypoplasia of lymph vessels resulting in the accumulation of excessive lymph fluid. Such condition can cause extreme pain and swelling. This accumulation of fluid often occurs in the arm and hand of a breast cancer patient after the removal of lymph nodes or radiation therapy which may reduce the full function of lymph nodes adjacent one of the patient's upper extremities.

Patients who have had radiation or lymph nodes removed as treatment for breast cancer need to be very careful of activities performed on their hand and arm on that side. That is, they should not do any heavy lifting with this arm or hand and should prevent any trauma thereto such as bruising or cutting. When such a person is confined to a healthcare facility such as a hospital or nursing home it is important that the patient informs the healthcare workers that no testing or other activities should be performed on that particular hand and arm which would cause any type of trauma to the arm. Such activities would include the taking of blood pressure on that arm or any type of venipuncture or taking of blood from a vein on that arm or from the back of a hand on that arm or even from the tips of the fingers on that arm. Furthermore the affected arm should not be used for any intravenous connections of any sort.

Normally a patient 10 would be able to inform a healthcare worker of this condition. However, it is common in healthcare environments or in other emergency situations that the patient is unable to provide this notification. In healthcare environments often a patient is asleep or unconscious or sedated or in a coma and cannot inform the healthcare worker that they have a susceptibility to lymphedema in one particular arm and hand. The susceptibility to lymphedema may have occurred years before as a result of breast cancer or other trauma to the lymph nodes adjacent that arm and the healthcare worker would not otherwise be knowledgeable as to this condition. The present invention provides an upper extremity covering means 14 with a plurality of warning indicia 30 thereon. The upper extremity covering 14 is designed to be worn on the affected arm by a healthcare patient particularly when in the healthcare environment such as a hospital or a nursing home which will inform any healthcare worker, even if the healthcare worker has never seen the patient previously or spoken to the patient previously, that no testing of any sort is to be performed with respect to the affected arm and hand area. Thus, the warning indicia 30 displayed prominently on the upper extremity covering 14 may include warnings such as indicia 32 "NO BLOOD PRESSURE" or indicia 34 reading "NO VENIPUNCTURE" or indicia 36 reading "NO INTRAVENOUS" or indicia 38 reading "NO TESTS ON THIS ARM".

The upper extremity covering will particularly include a tubular arm covering 16 which defines an arm entry opening 18 and a hand exit opening 20. As such the tubular arm covering 16 can be worn by the patient 10 simply by having the patient place his/her hand 12 and arm 11 through the arm entry opening 18 and then passing the patient's hand 12 outwardly through the hand exit opening 20. In this position the tubular arm covering 16 will extend about the arm of a user from a position preferably near the armpit to a position all the way down to the wrist. In this manner the tubular arm covering 16 will completely cover the entire arm area.

A hand covering 24 will preferably also be included and will define a hand entry opening 26 into which the patient's hand 12 can extend for completely covering the hand area. The hand covering 24 will preferably also include finger covering 28 adapted to cover all of the fingers of a user such as does a conventional glove to further prevent a healthcare worker from having access even to the fingers of the wearer. In the preferred configuration of the present invention the tubular arm covering 16 and the hand covering 24 will be a single integral unit with the hand entry opening 26 and the hand exit opening 20 in registration and contiguous with respect to one another.

With this configuration the overall upper extremity covering 14 will cover the user's arm from an area high above the elbow to a position all the way to the tips of the fingers in order to discourage a healthcare worker from performing testing on that arm. In another preferred configuration the upper extremity covering 14 will be formed of a woven fabric which is impenetrable or at least resistant to penetration thereof by needles or other implements to further protect the arm and hand 11 and 12 of the affected patient 10 that is susceptible to lymphedema. In use a patient 10 in a healthcare environment will place their affected arm and hand 11 and 12 into the protective arm and hand covering such that the various indicia thereon are prominently displayed. In this manner if the patient 10 is asleep or unconscious or sedated or in a coma for any reason, the healthcare worker will be informed that all testing should be performed on the patient's opposite arm. Having such notification prominently displayed on an arm which has a propensity for contracting lymphedema is an important aspect of placing a hospital or nursing care patient at ease within the otherwise mentally demanding environment. Such an arm and hand covering 13 provides ease of mind not otherwise possible for a patient who has a propensity for lymphedema in one arm. Such a patient can feel comfortable in falling asleep knowing that full notification will be given to any healthcare worker for any reason.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A protective arm and hand covering for a patient for preventing access thereto by a healthcare worker in order to prevent lymphedema comprising:

A. an upper extremity covering means comprising:

(1) a tubular arm covering means extending over and around the arm of a patient, said tubular arm covering means defining an arm entry opening means therein to facilitate placement of a patient's arm thereinto to allow said tubular arm covering means to extend over and around the arm of patient, said tubular arm covering means also defining a hand exit opening means spatially disposed from said arm entry opening means to allow the hand of a patient to extend outwardly therethrough;

(2) a hand covering means extending over and around the hand of a patient, said hand covering means defining a hand entry opening means therein to facilitate placement of a patient's hand thereinto; and B. a warning indicia means displayed prominently on said upper extremity covering means to discourage a healthcare worker from having access to an arm and hand of a patient.

2. A protective arm and hand covering for a patient for preventing access thereto by a healthcare worker in order to prevent lymphedema as defined in claim 1 wherein said hand covering means includes a finger covering means positioned extending over and around the fingers of a patient to prevent access thereto.

3. A protective arm and hand covering for a patient for preventing access thereto by a healthcare worker in order to prevent lymphedema as defined in claim 1 wherein said tubular arm covering means is made of a fabric which is resistant to penetration thereof in order to further prevent access to the arm of a patient by a healthcare worker.

4. A protective arm and hand covering for a patient for preventing access thereto by a healthcare worker in order to prevent lymphedema as defined in claim 1 wherein said hand covering means is made of a fabric which is resistant to penetration thereof in order to further prevent access to the arm of a patient by a healthcare worker.

5. A protective arm and hand covering for a patient for preventing access thereto by a healthcare worker in order to prevent lymphedema as defined in claim 1 wherein said tubular arm covering means and said hand covering means are affixed with respect to one another with said hand exit opening means in registration with respect to said hand entry opening means.

6. A protective arm and hand covering for a patient for preventing access thereto by a healthcare worker in order to prevent lymphedema as defined in claim 1 wherein said tubular arm covering means and said hand covering means are formed as a single integral member with said hand exit opening means immediately adjacent and contiguous with said hand entry opening means.

7. A protective arm and hand covering for a patient for preventing access thereto by a healthcare worker in order to prevent lymphedema as defined in claim 1 wherein said warning indicia means is displayed on said tubular arm covering means to discourage access by a healthcare worker to the patient's arm.

8. A protective arm and hand covering for a patient for preventing access thereto by a healthcare worker in order to prevent lymphedema as defined in claim 1 wherein said warning indicia means is displayed on said hand covering means to discourage access by a healthcare worker to the patient's hand.

9. A protective arm and hand covering for a patient for preventing access thereto by a healthcare worker in order to prevent lymphedema as defined in claim 1 wherein said warning indicia means is displayed on said tubular arm covering means adjacent said arm entry opening means to further discourage access by a healthcare worker to this patient's arm.

10. A protective arm and hand covering for a patient for preventing access thereto by a healthcare worker in order to prevent lymphedema as defined in claim 1 wherein said warning indicia means is displayed on said tubular arm covering means adjacent the front of a patient's elbow area to discourage a healthcare worker from access to a patient's arm.

11. A protective arm and hand covering for a patient for preventing access thereto by a healthcare worker in order to prevent lymphedema as defined in claim 1 wherein said tubular arm covering means is made of an impenetrable woven fabric.

12. A protective arm and hand covering for a patient for preventing access thereto by a healthcare worker in order to prevent lymphedema as defined in claim 1 wherein said hand covering means is made of an impenetrable woven fabric.

13. A protective arm and hand covering for a patient for preventing access thereto by a healthcare worker in order to prevent lymphedema as defined in claim 1 wherein said hand covering means extends over and around the entire hand, fingers and fingertips of a patient.

14. A protective arm and hand covering for a patient for preventing access thereto by a healthcare worker in order to prevent lymphedema as defined in claim 1 wherein said warning indicia comprises "NO VENIPUNCTURE".

15. A protective arm and hand covering for a patient for preventing access thereto by a healthcare worker in order to prevent lymphedema as defined in claim 1 wherein said warning indicia comprises "NO BLOOD PRESSURE".

16. A protective arm and hand covering for a patient for preventing access thereto by a healthcare worker in order to prevent lymphedema as defined in claim 1 wherein said warning indicia comprises "NO INTRAVENOUS".

17. A protective arm and hand covering for a patient for preventing access thereto by a healthcare worker in order to prevent lymphedema as defined in claim 1 wherein said warning indicia comprises "NO TESTS ON THIS ARM".

18. A protective arm and hand covering for a patient for preventing access thereto by a healthcare worker in order to prevent lymphedema as defined in claim 1 wherein said tubular arm covering means includes a transparent window means defined therein to facilitate viewing of a hospital identification bracelet therethrough.

19. A protective arm and hand covering for a patient for preventing access thereto by a healthcare worker in order to prevent lymphedema comprising:

A. an upper extremity covering means comprising:

(1) a tubular arm covering means extending over and around the arm of a patient, said tubular arm covering means defining an arm entry opening means therein to facilitate placement of a patient's arm thereinto to allow said tubular arm covering means to extend over and around the arm of patient, said tubular arm covering means also defining a hand exit opening means spatially disposed from said arm entry opening means to allow the hand of a patient to extend outwardly therethrough;

(2) a hand covering means extending over and around the hand of a patient, said hand covering means defining a hand entry opening means therein to facilitate placement of a patient's hand thereinto, said hand covering means including a finger covering means positioned extending over and around the fingers of a patient to prevent access thereto, said tubular arm covering means and said hand covering means being integral with respect to one another with said hand exit opening means in registration contiguous with respect to said hand entry opening means; and B. a warning indicia means displayed prominently on said tubular arm covering means of said upper extremity covering means to discourage a healthcare worker from having access to an arm and hand of a patient.

20. A protective arm and hand covering for a patient for preventing access thereto by a healthcare worker in order to prevent lymphedema comprising:

A. an upper extremity covering means comprising:

(1) a tubular arm covering means extending over and around the arm of a patient, said tubular arm covering means defining an arm entry opening means therein to facilitate placement of a patient's arm thereinto to allow said tubular arm covering means to extend over and around the arm of patient, said tubular arm covering means also defining a hand exit opening means spatially disposed from said arm entry opening means to allow the hand of a patient to extend outwardly therethrough, said tubular arm covering means being made of an impenetrable woven fabric which is resistant to penetration thereof in order to further prevent access to the arm of a patient by a healthcare worker, said tubular arm covering means including a transparent window means defined therein to facilitate viewing of a hospital identification bracelet therethrough;

(2) a hand covering means extending over and around the hand of a patient, said hand covering means defining a hand entry opening means therein to facilitate placement of a patient's hand thereinto, said hand covering means including a finger covering means positioned extending over and around the fingers of a patient to prevent access thereto, said tubular arm covering means and said hand covering means being integral with respect to one another with said hand exit opening means in registration contiguous with respect to said hand entry opening means, said hand covering means being made of an impenetrable woven fabric which is resistant to penetration thereof in order to further prevent access to the arm of a patient by a healthcare worker; and B. a warning indicia means displayed prominently on said tubular arm covering means of said upper extremity covering means to discourage a healthcare worker from having access to an arm and hand of a patient, said warning indicia means being displayed on said tubular arm covering means adjacent said arm entry opening means and adjacent the front of a patient's elbow area to further discourage access by a healthcare worker to the patient's arm, said warning indicia means including comprising "NO BLOOD PRESSURE" and "NO VENIPUNCTURE" and "NO INTRAVENOUS" AND "NO TESTS ON THIS ARM".

* * * * *